US007357200B2

(12) United States Patent
Harleman

(10) Patent No.: US 7,357,200 B2
(45) Date of Patent: Apr. 15, 2008

(54) EARTH AUGER

(76) Inventor: Ronald E. Harleman, 4370 NW. 751 Rd., Appleton City, MO (US) 64724

( * ) Notice: Subject to any disclaimer, the term of this patent is extended or adjusted under 35 U.S.C. 154(b) by 53 days.

(21) Appl. No.: 11/238,343

(22) Filed: Sep. 29, 2005

(65) Prior Publication Data

US 2007/0068706 A1 Mar. 29, 2007

(51) Int. Cl.
*E21B 17/22* (2006.01)
*E21B 7/00* (2006.01)
*E21B 10/36* (2006.01)

(52) U.S. Cl. ..... 175/323; 175/57; 175/425

(58) Field of Classification Search ..... 175/323, 175/391, 394, 412, 413
See application file for complete search history.

(56) References Cited

U.S. PATENT DOCUMENTS

| | | | | |
|---|---|---|---|---|
| 1,803,183 | A | 4/1931 | Hardsocg | |
| 2,578,014 | A | 12/1951 | Petersen | |
| 2,594,261 | A * | 4/1952 | Henning | 175/391 |
| 2,731,237 | A | 1/1956 | Henning | |
| 2,780,439 | A | 2/1957 | Kandle | |
| 2,817,497 | A | 12/1957 | Lines | |
| 3,024,856 | A * | 3/1962 | Henning | 175/391 |
| 3,024,858 | A | 3/1962 | Henning | |
| 3,106,973 | A | 10/1963 | Christensen | |
| 3,235,018 | A | 2/1966 | Troeppl | |
| 3,422,915 | A | 1/1969 | Watts | |
| 3,444,940 | A * | 5/1969 | Thomas et al. | 175/394 |
| 3,794,129 | A * | 2/1974 | Taylor | 175/391 |
| 3,821,993 | A | 7/1974 | Kniff et al. | |
| 3,898,895 | A | 8/1975 | Taylor | |
| 3,995,706 | A | 12/1976 | White | |
| 4,022,286 | A * | 5/1977 | Gill | 175/313 |
| 4,046,207 | A | 9/1977 | Taylor | |
| 4,266,830 | A * | 5/1981 | Retka et al. | 198/778 |
| 4,358,161 | A | 11/1982 | Needham | |
| 4,380,271 | A | 4/1983 | Baker et al. | |
| 4,917,196 | A | 4/1990 | Stiffler et al. | |
| 5,143,163 | A | 9/1992 | Stiffler et al. | |
| 5,197,555 | A | 3/1993 | Estes | |
| 5,366,031 | A * | 11/1994 | Rickards | 175/354 |
| 5,427,191 | A * | 6/1995 | Rickards | 175/354 |
| 5,476,149 | A * | 12/1995 | Rickards | 175/388 |
| 5,657,827 | A | 8/1997 | Roth | |
| 6,619,413 | B2 | 9/2003 | Hamilton et al. | |
| 6,851,758 | B2 * | 2/2005 | Beach | 299/107 |
| 2004/0118615 | A1 * | 6/2004 | Beach | 175/394 |

* cited by examiner

*Primary Examiner*—Frank Tsay
(74) *Attorney, Agent, or Firm*—Chase Law Firm, L.C.

(57) ABSTRACT

An earth auger presents a shank having a spiral earth removing structure therearound. The structure first presents a series of spirally positioned housings with cutting teeth therein followed by a spiral cutting edge about the shank. The teeth are radially, vertically and angularly oriented so as to remove earth in a stair-step fashion with a pneumatic drill-like action. The cutting teeth are further arranged so that each subsequent cutting tooth, as measured from the initial shank penetrating end, removes earth prior to the contact of the preceding cutting tooth housing so as to preclude earth contact. The earth relief, the spiral cutting teeth arrangement, the radial displacement of the teeth relative to the shank, the vertical displacement among the teeth and the angular relationship of the teeth, alone and in combination, enhance drilling.

25 Claims, 2 Drawing Sheets

EARTH AUGER

BACKGROUND

This invention pertains to an earth auger and, more particularly, to an auger having a flight with a plurality of earth-penetrating teeth spirally positioned thereon.

Various earth augers have been designed for drilling holes through strata of various materials. Past designs have used spiral flights for earth penetration. Some devices have added cutting teeth which were said to enhance drilling.

One disadvantage with such augers is that the tooth configuration, the teeth spacing and their surface drag all have a negative effect on the efficiency of the drilling process. Past auger designs have allowed for soil build up between the teeth which can diminish, if not cease, the drilling action. Also, the teeth of previous augers simultaneously engaged the ground in the same plane which presents an inefficient scraping action, undesirable drag and instability, all which further diminish the drilling action. Moreover, past teeth were not relatively positioned so as to provide a pneumatic drill-type action on the earth during the drilling process.

Accordingly, it is desirable to present an effective auger which avoids these past problems so as to enhance the drilling process.

In response thereto I have invented a novel auger design. My auger design includes an axial shaft/shank having a spiral cutting flight wound therearound. The flight begins adjacent the initial penetration point of the shank and spirally winds about the shaft towards the opposed end of the shank. The initial portion of the cutting flight presents a plurality of conical cutting teeth which are spirally displaced from the shank to provide a succession of single earth penetrating cuts, i.e., each tooth engages the underlying surface prior to engagement of an upstream tooth. The teeth are radially and longitudinally spaced relative to the shank such that an imaginary line extending through the teeth defines a spiral cutting edge which cooperates with the subsequent upstream cutting edge of the spiral flight. Thus, a corkscrew drilling effect is presented. The teeth are positioned, relative to each other and a horizontal plane normally passing through the axial shank, such that a pneumatic drill type action is directed onto the earth while preventing earth buildup between the teeth. Such relationships present a discrete stair-stepped pattern of earth removal with the pneumatic effect of the teeth first weakening the tiered earth and then fracturing each tier for effective removal. Each subsequent tooth cuts an earth relief for the housing of the preceding teeth so as to preclude drag of the preceding teeth housing on the earth. The plurality of teeth extend 360° about the shaft which further enhances the drilling action.

Accordingly, it is a general object of the invention to provide an improved earth auger.

Another object of this invention is to provide an auger, as aforesaid, having an earth cutting spiral flight wound therearound with a plurality of earth penetrating teeth forming a portion of the spiral flight.

A further object of this invention is to provide an auger, as aforesaid, wherein the teeth are easily replaceable within their respective housings.

Another object of this invention is to provide an auger, as aforesaid, wherein the teeth extend at least 360° about an axial shank.

A further object of this invention is to present an auger, as aforesaid, wherein the teeth are radially spaced, relative to an imaginary central axis of the shank, so as to preclude earth build up between the teeth during the drilling action.

Another object of this invention is to provide an auger, as aforesaid, wherein the teeth are vertically spaced so as to provide a single cut, corkscrew drilling action.

A still further object of this invention is to provide an auger, as aforesaid, wherein the teeth are spirally, vertically and radially spaced so as to provide discrete stair-step tiers for earth removal during the drilling action.

Another object of this invention is to provide an auger, as aforesaid, wherein the teeth are positioned, relative to the earth, such that a pneumatic drill-type or chatter action is provided against the underlying earth.

Another object of this invention is to provide an auger, as aforesaid, wherein the aforesaid pneumatic and corkscrew actions enhance the drilling process.

A still further particular object of this invention is to provide an auger, as aforesaid, wherein the spiral flight presents a spiral cutting edge first presented by the plurality of teeth, as aforesaid, and then a spiral cutting edge.

Another particular object of this invention is to provide an auger, as aforesaid, wherein the auger design stabilizes the auger during the drilling action to preclude undesirable auger movement.

Other objects and advantages of this invention will become apparent from the following description taken in connection with the accompanying drawings, wherein is set forth by way of illustration and example, a now preferred embodiment of my invention.

DESCRIPTION

Figure 1:
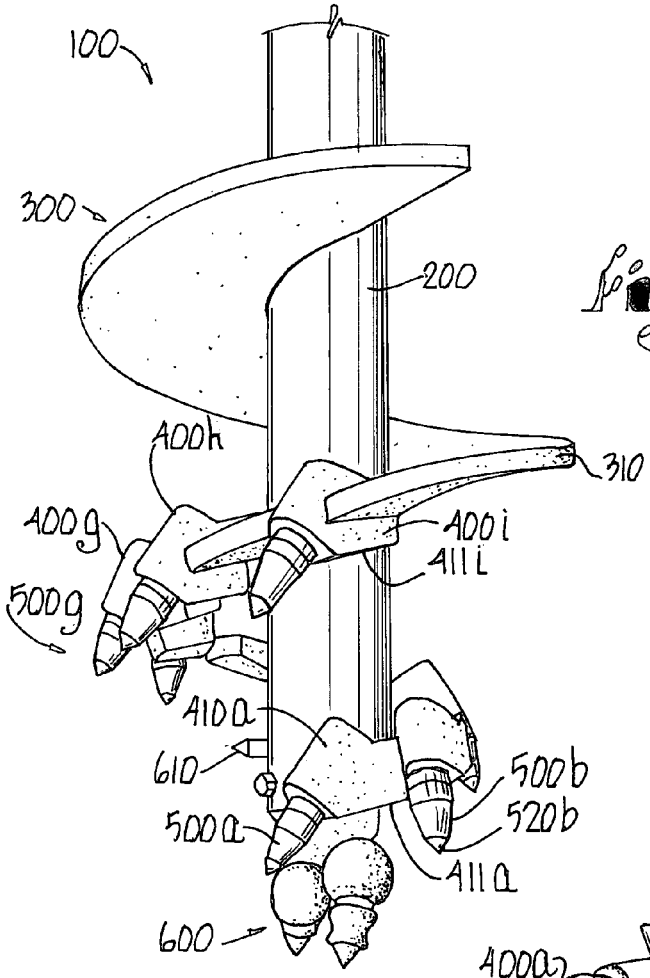
FIG. 1 is a view of the distal end of the auger showing the spiral flight with cutting teeth wound about the axial shank.
Figure 2:
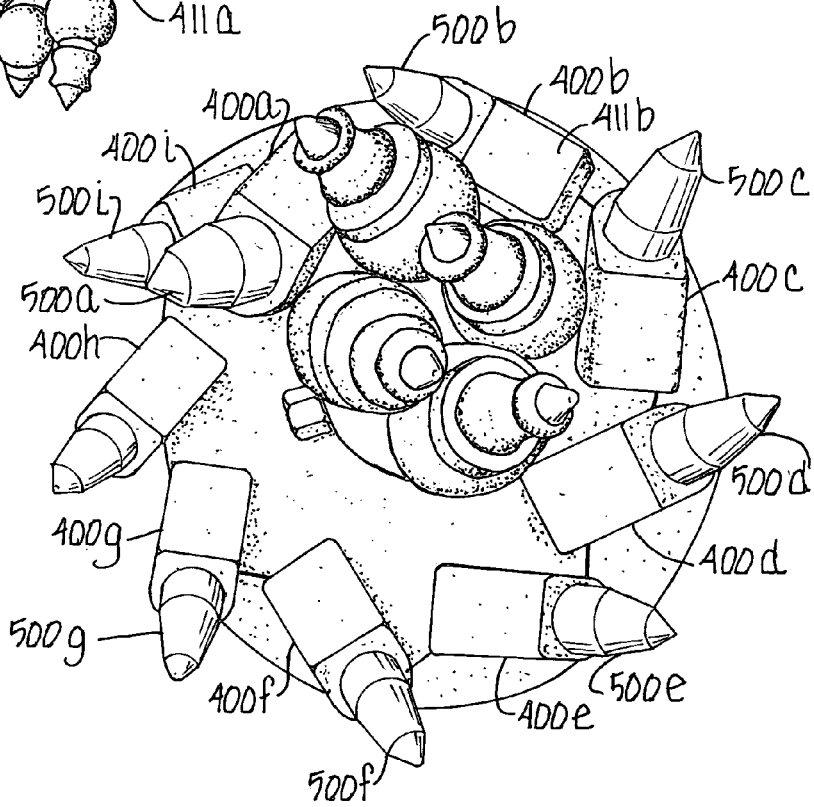
FIG. 2 is a bottom view of the auger of FIG. 1 on an enlarged scale.
Figure 3:
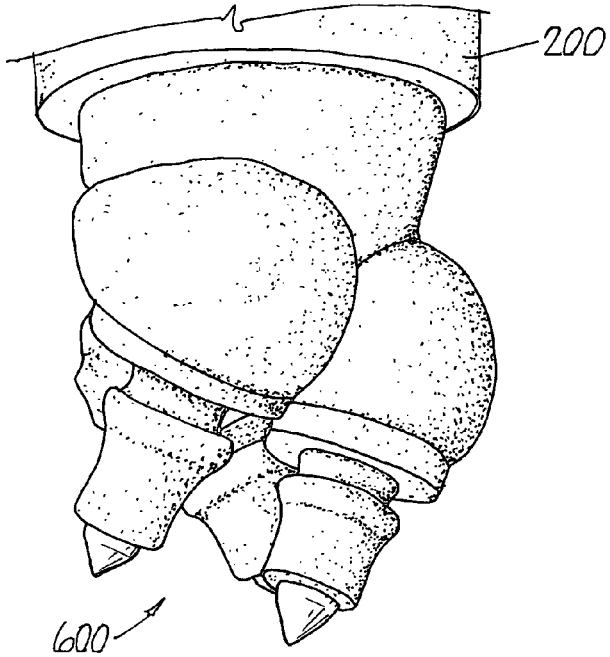
FIG. 3 is a view of the initial penetrating bits of the auger of FIG. 1 on an enlarged scale.

Turning more particularly to the drawings, FIG. 1 shows my auger 100 as generally comprising an axial shaft/shank 200 with a spiral flight 300 wound therearound. An upstream portion of the spiral flight 300 presents a continuous cutting edge 310. Along the downstream end of this spiral flight 300 are positioned a plurality of housings 400A-400I for holding Tungsten® carbide teeth 500A-500I in a spiral winding about the shank 200. A plurality of initial earth penetrating bits 600 are positioned at the end of the shank 200 with a scraper tooth 610 (phantom line) positioned along the shank 200. Bits 600 are used for initial earth penetration in a conventional manner with scraper tooth 610 keeping the earth moving away from the shank 200 during the auger operation.

My preferred embodiment herein is discussed in connection with a 16-inch auger although the principles disclosed herein can be utilized with larger or smaller augers. A plurality of housings 400A-400I present pockets for releasable engagement of the corresponding conical teeth 500A-

500I therein. These housings are spirally embedded along the initial portion of flight 300 and present teeth which form the initial cutting surface of the spiral flight 300. The housings 400 begin adjacent the penetrating end of the shank (4"D), i.e., 400A, and terminate with the upstream housing 400I. Subsequently, the spiral flight 300 continues beyond housing 400I and presents a continuous spiral cutting edge 310. Each housing includes a bottom wall 411 and a tooth wall 413 with aperture 415 therein. The shank 515 of each tooth fits within aperture 415 and is releasably held therein by a compression ring. Each tooth 500 preferably extends from the housing at an approximate 30° angle relative to a horizontal plane normal to the axis of shank 200. Moreover, the housings are angled relative to this imaginary central axis of the shank 200 so that an imaginary line passing through the initial penetration point 520 of each tooth 500 present a spiral edge beginning at 500A and continuing through tooth 500I. This spiral line presents a spiral cutting edge as presented by the plurality of teeth 500A-500I. This spiral cutting edge then continues in alignment with the subsequent continuous cutting edge 310 of the upstream portion of spiral flight 300.

The housings 400 are further radially positioned, relative to the shank 200, such that a plurality of circular contiguous cutting paths, relative to the shank 200, are presented by each tooth.

Figure 5:
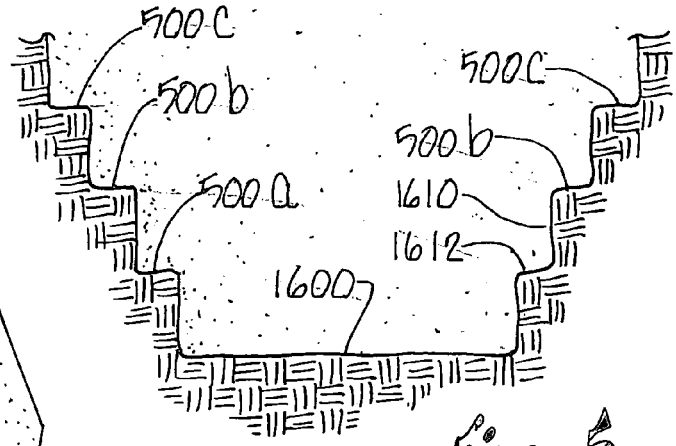
FIG. 5 is a diagrammatic view showing the stair-stepped configuration of earth removal provided by the drilling action of the auger of FIG. 1.
Figure 4:
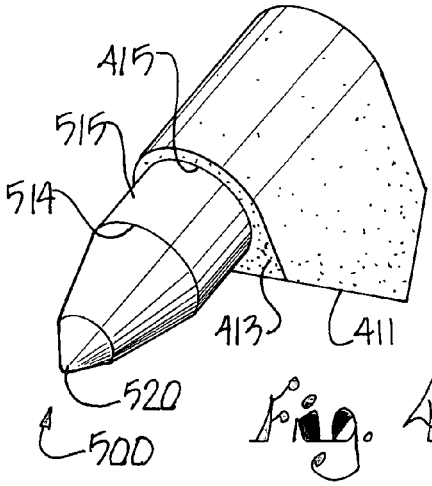
FIG. 4 is a view of one cutting tooth within its housing.

Each tooth 500 presents a conical-shaped configuration with an initial penetration point 520 conically tapering to an enlarged circular base 514 having a diameter of approximately three-fourths of an inch. The points 520 of teeth 500 are preferably radially spaced at one-half inch intervals from the shank 200 with tooth 500A initially being two inches therefrom. Tooth 500I is thus slightly more than eight inches from the center of the shank 200 so as to present an approximately 16-inch hole upon drilling during earth removal (FIG. 5). The circular cutting paths of adjacent teeth 500 overlap. This overlap precludes undesirable material build up or ridges between the teeth 500.

Also, the angle of each tooth 500, relative to a horizontal plane, is positioned such that each tooth 500 chatters or reciprocates when contacting earth or rock. I have found one preferred angle to be approximately 30°. This chatter creates a pneumatic drill-like effect on the rock which first weakens and then fractures the rock. Angles, significantly less or greater than 30° may cause the teeth to drag across the rock. This resulting drag inhibits chatter, drill rotation and effective rock removal.

The vertical displacement between adjacent teeth 500 points 520 are preferably one inch. The vertical one inch tooth 500 displacement coupled with the one-half inch radial tooth 500 displacement presents successive stair-stepped configurations of earth removal with a one-inch riser 1610 and a one-half inch tread 1612 as shown in FIG. 5. These dimensions of the stair-step configurations allow the rock to be more effectively removed during the drilling process. Moreover, the spiral configuration of the teeth 500A-500I presents a corkscrew effect such that the weight of the device 100 is directed onto each tooth 500 as it is making a single cut into a selected stratum. Thus, rock drilling is enhanced.

The housings 400, being oriented to position the teeth 500 as above described, may extend beyond the cutting path of its housed tooth 500. However, the relationship of the cutting teeth 500A-500I with the housings 400A-400I provides a drilling advantage as each subsequent tooth 500 cuts a relief into the rock such that the housing 400 of the preceding tooth 500 will not drag along rock. For example, the point 520B of tooth 500B extends below the lowermost wall 411A of the preceding housing 400A for tooth 500A. The cutting path of this tooth 500B thus removes rock positioned in its path prior to housing 400A passing through this tooth 500B path. Thus, these tooth/housing relationships assure there is no drag of a preceding housing along the earth. It is noted that tooth 500I, being beyond the eight inch radius relative to shank 200, cuts a relief for the cutting edge 310 of flight 300 and its own housing wall 411I.

During auger operation, bits 600 form an initial four inch hole 1600. The teeth 500A-500I, as above described, form a circular stair-step configuration such that a series of one-inch risers 1610 and one half inch treads 1612 are being successively presented. It is understood that these stair steps are radially displaced from the hole center as successive teeth penetrate the ground. The formation of the riser 1610 weakens the rock underlying the horizontal ledge 1612 such that the rock is more easily fractured, chipped and/or removed by the subsequent pneumatic-like chatter action of the teeth on the rock. As the spacing of the teeth 500, as above described, precludes rock formation between teeth and the earth has been previously weakened by the pneumatic chatter effect, the rock is more easily removed during auger operation. Thus, I have found that this auger design increases the speed of auger rotation as more teeth 500 get into the rock unlike in previous devices.

As the last tooth 500I is slightly positioned beyond an eight inch radius from the centerline of shank 200, this tooth 500I forms a relief for its own pocket housing 400I as well as for the subsequent cutting edge 310 of the spiral flight 300.

As above, the angle of each housing 400 and thus its tooth 500, relative to the vertical centerline of shank 200, changes as each housing progresses along the spiral path. (The tooth angle, relative to the horizontal, is maintained to maintain the chatter effect.) As above described this angular change helps maintain the pneumatic action on the rock and presents a spiral or "corkscrew" succession of cutting teeth 500A-500I onto the rock. Also, the spiral configuration of the teeth 500 forms the hole from the outside diameter to the center as opposed to other augers wherein the hole is formed from the center towards the outside. As above the weight of the auger 100 is thus directed onto only one cutting tooth passing through one cutting path along the extent of the spiral, i.e., a "single cut" action. This additional weight onto the "single cut" action enhances rock removal. Moreover, as only one tooth at a time is contacting the rock in a respective tooth cutting path, significant drag is eliminated as compared to a double cut auger wherein two or more teeth are being dragged through the same path. This spiral configuration is also effective when cutting through discrete layers of rock. For example, when a preceding tooth cuts through a hard rock layer and into softer earth therebelow the weight of the auger is then transferred to upstream or preceding teeth which are penetrating harder rock layers. This weight transfer enhances drilling. Also, the spiral penetration of the teeth into the earth stabilizes the auger 100 so as to preclude undesirable shifting away from the hole center.

Accordingly, my auger design, presenting the above advantages, provides an effective auger for enhanced removal of earth whether through the earth, rock or any other strata.

It is to be understood that while a certain form of this invention has been illustrated and described, it is not limited thereto, except in so far as such limitations are included in the following claims and allowable equivalents thereof.

Having thus described the invention, what is claimed as new and desired to be secured by Letters Patent is:

1. An earth drilling device comprising:

a center shank having an imaginary central axis, said shank presenting an earth penetrating end;

a flight wound about said shank, a portion of said flight helically extending between said earth penetrating end and an upstream position longitudinally displaced along said shank axis from said earth penetrating end and radially displaced from said shank axis at a distance approximating a desired radius of a hole to be drilled upon operation of the device;

a plurality of housings along said portion of said flight beginning adjacent said earth penetrating end, each housing presenting a cutting tooth having a configuration presenting a cutting path of a primary width, said plurality of housings with a respective tooth therein positioned along said flight portion to define a plurality of successively adjacent teeth corresponding to a plurality of adjacent cutting paths helically wound about said shank axis between said earth penetrating end and said upstream position, each successively adjacent tooth of said plurality of teeth beginning at said shank end being radially displaced at successively increasing radial distances from said shank axis and longitudinally displaced from said shank end at successively increasing longitudinal distances, said radial distances resulting in cutting paths of adjacent teeth at least contiguous to preclude gaps between said cutting paths, one of said teeth being positioned approximate said desired radius distance from said axis, a portion of said flight subsequent to said housings presenting an earth cutting edge, whereby to form a flight having a first cutting portion defined by said helical teeth and a subsequent cutting portion defined by said subsequent cutting edge.

2. The device as claimed in claim 1 wherein each tooth extends from said housing at a preselected angle relative to a horizontal plane normally passing through said shank.

3. The device as claimed in claim 1 wherein said radial distance between adjacent cutting teeth is less than a width of a cutting path of one of said adjacent teeth to present an overlap of adjacent cutting paths during operation of the device.

4. The device as claimed in claim 3 wherein said adjacent teeth are positioned relative to each other such that one tooth of said adjacent teeth of said plurality of teeth extends below a housing of the other adjacent tooth, in a manner whereby said one adjacent tooth removes earth to allow for passage of said housing of said other tooth through said one adjacent tooth cutting path during operation of the device.

5. The device as claimed in claim 3 wherein said radial displacement between said adjacent teeth is approximately equal and said teeth longitudinal displacement along said central axis between said teeth is approximately equal.

6. The device as claimed in claim 1 wherein adjacent teeth of said plurality of teeth are positioned relative to each other such that one tooth of adjacent teeth of said plurality of teeth extends below a housing of the other adjacent tooth in a manner whereby said one adjacent tooth passing through a corresponding cutting path removes earth to allow for passage of said housing of the other adjacent tooth through said corresponding cutting path.

7. The device as claimed in claim 1 wherein said successively increasing radial distances of said teeth present radial increments between said teeth which are equal.

8. The device as claimed in claim 7 wherein the width of each cutting path presented by each cutting tooth is approximately equal.

9. The device as claimed in claim 8 wherein the radial distance between successive cutting paths of said teeth is less than the width of one of said successive cutting paths to present an overlap of cutting paths upon said device operation.

10. The device as claimed in claim 9 wherein said teeth extend at least 360° about said axis.

11. The device as claimed in claim 1 wherein said teeth extend at least 360° about said shank axis.

12. The device as claimed in claim 1 further comprising a cutting element on a side of said shank, said cutting element presenting a cutting path concentric about said shank axis upon said rotation of said device.

13. An earth drilling device comprising:

an axial shank including a central axis presenting an earth penetrating end;

a spiral cutting edge assembly helically wound about said shank, said assembly comprising:

a plurality of cutting teeth housings helically positioned at least 360° about said shank axis, each housing including a cutting tooth, said housings including an initial housing presenting a first cutting tooth positioned adjacent said penetrating end of said shank at a first radial distance from said axis and an upstream housing presenting a cutting tooth positioned upstream from said first cutting tooth housing with a plurality of cutting teeth housings positioned therebetween and helically wound about said shank, said upstream cutting tooth housing presenting a tooth radially displaced from said shank at a distance approximate a radius of said hole to be presented by operation of said device, said plurality of cutting tooth housings between said first and upstream housings helically positioned about said shank, each housing being positioned to present each adjacent tooth at a successively larger radial increment relative to said central axis with each successively adjacent tooth presenting successively adjacent contiguous cutting paths about said axis upon operation of said device, said teeth longitudinally displaced relative to said central axis in a manner whereby only one tooth at a time passes through a plane normal to said axis upon operation of said device.

14. The device as claimed in claim 13 wherein each cutting tooth presents a respective cutting path of a primary width about said shank during said operation of said device, said cutting teeth radial increments of adjacent teeth being spaced relative to said shank axis to present a successive series of at least contiguous cutting paths about said shank, whereby to preclude a radial displacement between said cutting paths and earth buildup between said teeth upon said operation of said device.

15. The device as claimed in claim 14 wherein a subsequent cutting tooth of a subsequent upstream housing relative to said shank end extends below a preceding housing of a preceding cutting tooth, whereby during said operation said subsequent cutting tooth removes earth in its cutting path prior to a passage of said preceding housing through said path.

16. The device as claimed in claim 14 wherein said radial spacing between adjacent cutting teeth are equal.

17. The device as claimed in claim 16 wherein vertical distances between adjacent cutting teeth are equal.

18. The device as claimed in claim 14 wherein said cutting teeth increments are selected to present an overlap of adjacent cutting paths during said operation.

19. The device as claimed in claim 13 further comprising at least one drill bit on said shank for earth penetration, said at least one bit further clearing a path for said initial cutting tooth housing.

20. The device as claimed in claim 13 further comprising a cutting element on said shank radially displaced from said axis whereby to present a continuous earth movement about said shank during said operation of said device.

21. An earth drilling device comprising:

an axial shank presenting an earth penetrating end;

a plurality of cutting teeth;

means for positioning said cutting teeth in a spiral helical pattern at least 360° about said shank wherein a first cutting tooth is positioned adjacent said earth penetrating end at a first radial distance from said shank and a plurality of adjacent subsequent teeth are positioned at a selected longitudinal distances along said shank and radial displacements from said shank, said radial distance of one tooth of said plurality of teeth approximately a radius of a hole to be presented by a drilling operation of said device.

22. The device as claimed in claim 21 wherein each tooth presents a cutting surface for cutting an adjacent path in the earth of a basic width, said means further positions adjacent teeth of said plurality of cutting teeth at selected radial distances therebetween, whereby upon an operation of said device each tooth presents a cutting path in the earth concentric about an axis of said axial shank, each radial distance selected to present a cutting path of each tooth at least contiguous a cutting path of an adjacent tooth, whereby to preclude gaps between said cutting paths and earth buildup between said teeth during said device operation.

23. The device as claimed in claim 22 wherein each radial distance of adjacent teeth is selected so that cutting paths of adjacent teeth overlap during said operation.

24. The device as claimed in claim 21 further comprising means on said earth penetrating end for providing a continuous movement of earth adjacent said shank during said operation.

25. The device as claimed in claim 21 further comprising a plurality of cutting bits extending from said shank end to enhance earth penetration.

* * * * *